US006339982B1

(12) United States Patent
Angel et al.

(10) Patent No.: US 6,339,982 B1
(45) **Date of Patent: *Jan. 22, 2002**

(54) CUTTING MECHANISM AND A PRINTING DEVICE WITH AUTOMATIC CUT

(75) Inventors: Clive Graham Angel, Hertfordshire; Clive Lawrence Ayling, Hauxton; Graham Scott Gutsell, Harston, all of (GB)

(73) Assignee: Esselte NV, Niklaas (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,959

(22) Filed: Jan. 14, 1999

Related U.S. Application Data

(62) Division of application No. 08/855,417, filed on May 13, 1997, now Pat. No. 6,014,921.

(30) Foreign Application Priority Data

| | | |
|---|---|---|
| May 14, 1996 | (GB) | 9610028 |
| Jul. 5, 1996 | (GB) | 9614112 |
| Jul. 5, 1996 | (GB) | 9614146 |

(51) Int. Cl.[7] ..... B26D 5/20

(52) U.S. Cl. ..... 83/76.9; 83/862; 83/485; 83/488; 83/563; 83/614; 400/621

(58) Field of Search ..... 83/485, 487, 488, 83/508, 563, 582, 614, 862; 400/582, 621, 615.2

(56) References Cited

U.S. PATENT DOCUMENTS

| | | | | |
|---|---|---|---|---|
| 3,858,018 | A | 12/1974 | Walley | 200/153 LA |
| 3,886,032 | A | 5/1975 | Artelt, Jr. | 156/521 |
| 3,969,615 | A | 7/1976 | Bower et al. | 235/151.11 |
| 4,003,281 | A | 1/1977 | Kumpf et al. | 83/483 |
| 4,175,858 | A | 11/1979 | Meadows | 355/99 |
| 4,280,865 | A | 7/1981 | Simonton | 156/538 |
| 4,459,889 | A | 7/1984 | Holton et al. | 83/597 |
| 4,519,285 | A | 5/1985 | Dontscheff | 83/880 |
| 4,544,293 | A | 10/1985 | Cranston et al. | 400/320 |
| 5,046,392 | A | 9/1991 | Keon et al. | 83/862 |
| 5,066,152 | A | 11/1991 | Kuzuya et al. | 400/621 |

(List continued on next page.)

FOREIGN PATENT DOCUMENTS

| | | |
|---|---|---|
| EP | 0 319 209 | 6/1989 |
| EP | 0 578 372 | 1/1994 |
| EP | 0 607 026 | 1/1994 |
| EP | 0 634 275 | 6/1994 |
| EP | 0 652 110 | 5/1995 |
| EP | 0 711 637 | 8/1995 |
| EP | 0 719 620 | 12/1995 |
| GB | 218813 | 6/1923 |
| GB | 1396887 | 6/1971 |
| GB | 2049530 | 6/1980 |
| GB | 2 088 825 | 6/1982 |
| GB | 2 289 430 | 11/1995 |

*Primary Examiner*—S. Thomas Hughes
*Assistant Examiner*—Sean Smith

(57) ABSTRACT

A cutting mechanism having a movable carriage and two cutters. Each cutter has an anvil that opposes a blade, and one of these is a roller that rolls against the other for progressively biasing material against the blades, producing cuts through the material. The rollers are rotatably mounted to the carriage, which is mounted to a lead screw that controls the position of the carriage. As the carriage moves across the material, the rollers roll, and the material is cut. The space between the anvil and the blade of at least one of the cutters can be varied to disengage that cutter so that the rolling of the roller will not cut the material. The engagement and disengagement of the cutter is dependent on the position of the carriage.

19 Claims, 13 Drawing Sheets

U.S. PATENT DOCUMENTS 5,271,789 A 12/1993 Takagi et al. ..... 156/387
5,436,646 A 7/1995 Schilling et al. ..... 346/139 R
5,441,352 A * 8/1995 Shiota ..... 400/621
5,458,423 A 10/1995 Sims et al. ..... 400/621
5,503,053 A 4/1996 Onishi et al. ..... 83/488
5,538,352 A * 7/1996 Sugiura ..... 400/615.2
5,595,101 A 1/1997 Yoishimatsu et al. ..... 83/40
5,605,087 A * 2/1997 Beadman ..... 83/881
5,610,648 A 3/1997 Sims et al. ..... 347/174
5,676,478 A * 10/1997 Bowman et al. ..... 400/621
5,699,741 A * 12/1997 Schmidt et al. ..... 101/485
5,718,528 A 2/1998 Halket et al. ..... 400/621
5,768,991 A * 6/1998 Cless et al. ..... 101/227
5,775,193 A 7/1998 Pratt ..... 83/659
5,826,994 A * 10/1998 Palmer ..... 400/615.2

* cited by examiner

CUTTING MECHANISM AND A PRINTING DEVICE WITH AUTOMATIC CUT

This is a division of application Ser. No. 08/855,417, filed May 13, 1997 U.S. Pat No. 6,014,921.

FIELD OF THE INVENTION

The present invention relates to a cutting mechanism for making two cuts through a material. More particularly, it relates to a printing device having anvils that roll against blades to produce cuts of different depths through a tape.

BACKGROUND OF THE INVENTION

Electronic printing apparatus are known which use a supply of multi-layer tape, housed in a cassette received by the printing apparatus. The multi-layer tape comprises an image receiving layer and a backing layer secured to one another via an adhesive layer. After an image has been printed onto the image receiving layer, the backing layer can be removed allowing the receiving layer to be secured to an object using the adhesive layer. Such printing apparatus include cutting mechanisms for cutting off a portion of the tape for its use as a label after an image has been printed onto the image receiving layer. For this purpose, the cutting mechanism includes a blade for cutting through all of the layers of the multi-layer tape. In some printing apparatus, the cutting mechanism also includes a tab cut blade for cutting through only one of the layers of the multi-layer tape, either the image receiving layer or the backing layer, leaving the other layer intact. For example, in a machine made and sold by Esselte under the trade mark DYMO 6000, a tab cut blade is provided which cuts through the top image receiving layer while leaving the backing layer intact. Such a tab cut allows easy separation of the image receiving layer from the backing layer.

In the DYMO 6000, the tab cut blade is a ceramic blade which is set via insert molding in a tab cut blade holder to a protrusion of about 100 microns. When a tab cut is to be made, force is applied to the blade holder to cause the blade to cut through the image receiving layer of the tape while the tape is supported by a flat anvil surface. Precise control of the amount of blade protruding from the blade holder ensures that a reliable tab cut is made which always cuts through the image receiving layer without cutting the backing layer.

One problem with this arrangement is that it requires the application of significant force, particularly when cutting wide tapes. These printing apparatus operate with tapes having widths of 6 mm, 12 mm and 19 mm. When performing a tab cut on a 19 mm tape, the force required can be as much as 80 to 100 N. It is very difficult for smaller printing apparatus to apply the high loads that the cutting operation requires.

A cutting mechanism which overcomes this difficulty is described in our copending U.S. application Ser. No. 08/556,885. In the disclosed cutting mechanism, an anvil is mounted for rolling motion relative to a cutting blade. To perform a cut, the anvil is rolled along the blade, progressively cutting across the tape. Thus, the actuation force required in this operation is much lower than if the entire width of tape were to be cut simultaneously.

In the '885 application, in which the rolling anvil is used to implement a tab cut, a full cut is implemented by a separate cutting mechanism, mechanically connected to the rolling anvil. This separate mechanism forces the entire cutting edge of a blade against a stationary anvil at once, and hence requires a large force to be applied during the cut.

As described in U.S. Pat. No. 5,458,423, a mechanism that produces a full cut can be disabled so that only a tab cutting mechanism operates. This allows a string of labels to be produced, wherein the labels are secured to a common backing strip and separated by tab cuts. The disabling of the full cutting mechanism in this reference, however, must be done manually. From a practical point of view, this means that the machine must be located accessibly to a user.

It is desirable to provide for remote printing devices which can operate by communication with host PCs or other desktop label formulation apparatus. Such printing and cutting devices can be controlled remotely from the printing apparatus itself.

SUMMARY OF THE INVENTION

The present invention relates to a cutting mechanism for cutting a material, such as a multilayer tape. The mechanism has first and second cutters respectively with first and second opposing blade and anvil components. Either the first anvil or blade component and either the second anvil or blade component are rollers that are mounted for rolling along the anvil or blade component opposed to each roller. This rolling motion progressively biases and cuts the material with the first blade component. Likewise, one of the second anvil and blade components is in the form of a second roller mounted for rolling along the other for progressively biasing and cutting the tape with the second blade component. Preferably, the first blade and anvil components are arranged to cooperatively cut through all layers and the entire thickness of the multi-layer tapes and the second blade and anvil components are arranged to cooperatively cut through one or more layers of the multi-layer tape, while leaving at least one layer and a portion of the thickness of the tape intact.

The rollers are preferably the anvil components, and are rotatably mounted on a carriage that is movable parallel to the blades. As the carriage moves, the anvil components roll over the blades, widthwise with respect to the tape, thus cutting the tape.

The resulting cutting -mechanism can make a tab cut and a full cut through a multi-layer tape at locations spaced along the length of the tape. The cutting mechanism is particularly useful in printing devices of the type hereinbefore described.

The present invention can also provides a printing device with the described cutting mechanism. This printing device can be operated from an input device such as a keyboard, in which a user may enter information such as characters to be printed, length of label, and format of label, and may select other modes for the printer to operate.

The printing device preferably also includes a printing mechanism comprising a printhead and platen for performing printing operations.

In one type of suitable printing device, an multilayer image-receiving tape is passed in overlap with a thermal transfer ribbon through the printing mechanism. The tape is fed through the printing location by a motor arranged to drive the platen or a set of feed rollers to pull the tape past the printing location. The printing device preferably has a controller in the form of a microprocessor which controls the timing and positioning of printing with respect to the movement of the tape, according to the data entered by the user. The thermal printhead has a column of printing elements so that an image is printed on the tape column by column as the tape moves past the printing mechanism.

In normal operations, the tape is printed upon, and tab and full cuts are made to produce a label. Alternatively, tab cuts can be made at spaced locations along the length of the tape to produce numerous labels which can then be removed from a common backing. To achieve this, one of the cutters is selectively disengageable, for example by increasing the spacing between an opposing blade and anvil, so that the cutter will not produce a cut in its disengaged state. Preferably, this cutter can be engaged and disengaged by moving the rolling anvils passed predetermined positions.

Preferably, each anvil component has a circumferential slot aligned with its opposing blade component to prevent direct contact between the blade component and the surface of the anvil component. This arrangement reduces damage and wear of the cutters. The amount by which each blade component protrudes from a blade holder can be less accurately controlled than when used with an anvil component that lacks the slot. This relaxes the tolerances on production blade straightness. With these slots, a common blade holder can be used to hold two blade components protruding therefrom by different amounts, one protruding sufficiently to produce a tab cut, and the other to produce a full cut through the thickness of the tape.

The input device, or other user interface, does not need to form part of a common housing with the printing mechanism and cutting mechanism, but may be disposed remotely therefrom. A remote arrangement allows the user to control the cutting mechanism, without the needing to intervene manually.

The invention also provides a lead screw with a cam on its end. The lead screw is received through an internally threaded bore in the carriage. A switch, resiliently biased against the cam produces electrical pulses, and a counter of the controller measures the position of the carriage.

This invention enables a user to implement a variety of label options, such as printing multiple copies of labels, wherein copies can be counted more simply than with earlier printing devices.

BRIEF DESCRIPTION OF THE DRAWINGS

Reference will now be made by way of example to the accompanying drawings in which.

DESCRIPTION OF THE PREFERRED EMBODIMENT

Figures 1, 2:
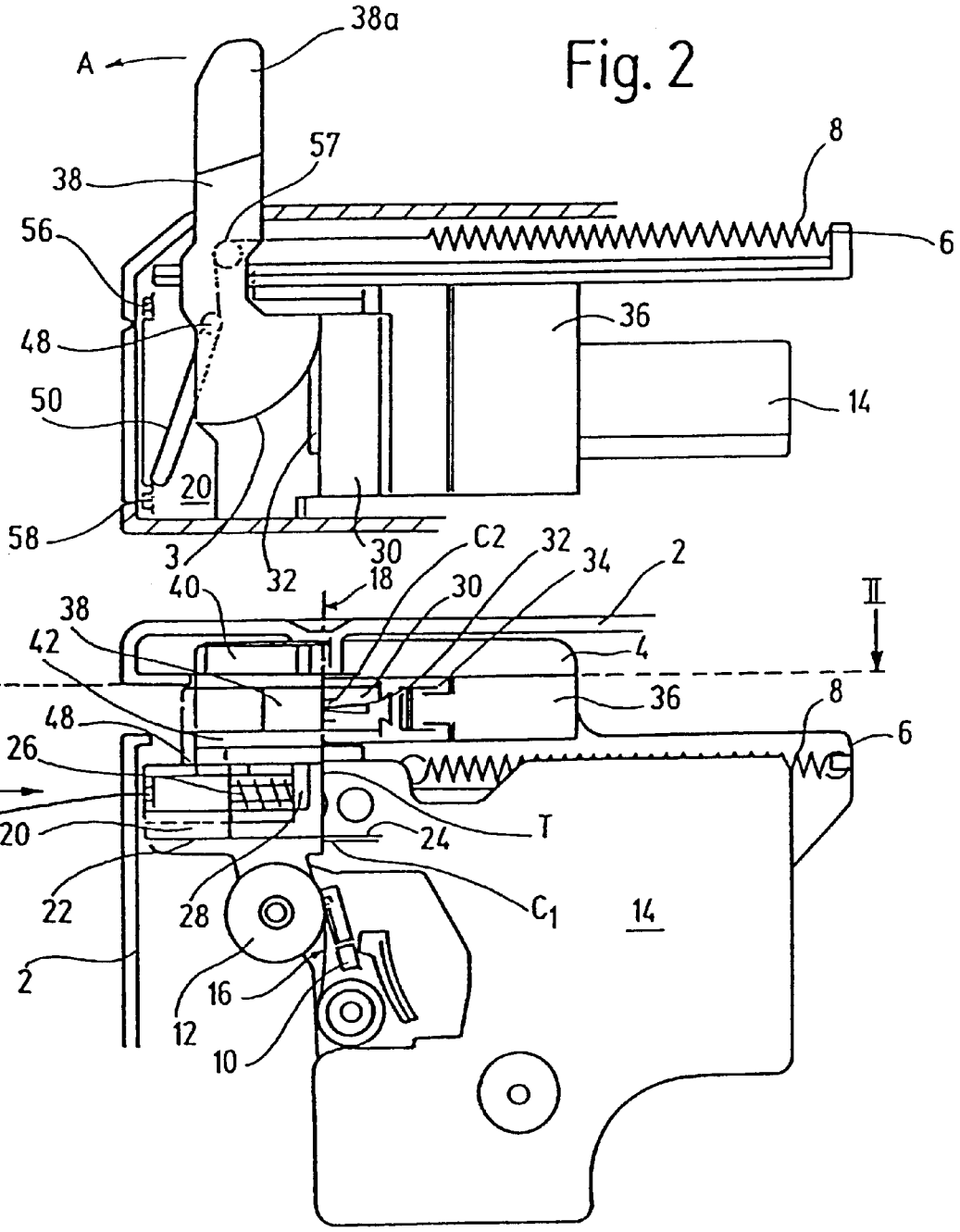
FIG. 1 is a plan view of a cutting mechanism in a printing device with a cassette.
FIG. 2 is a section taken along lines II—II of FIG. 1, showing the rolling anvil in a start position.

FIGS. 1 and 2 are views of a cutting mechanism as described in U.S. patent application Ser. No. 08/556,885 shown in a printing apparatus that has a printing mechanism and in which a cassette is located. The content of that application is expressly incorporated herein by reference thereto to the extent needed for a complete understanding of the invention. Reference numeral 2 designates a casing of the printing apparatus defining a cassette receiving bay. Within the casing 2 is located a base plate 4 which includes an upstanding part 6 used for mounting a return spring 8. The printing mechanism includes a printhead 10 and a platen 12 which cooperates with the printhead 10 to effect printing on an image receiving tape T. The printhead 10 and platen 12 are mounted within the casing 2 on the base plate 4. The printhead 10 is movable from the operative position as shown in FIG. 1 to an inoperative position in which it is spaced from the platen 12 to allow easy removal and insertion of a cassette. Reference numeral 14 denotes a cassette located in the cassette receiving bay. The cassette 14 holds a supply of ink ribbon and image receiving tape which extend in overlap between the platen and printhead 10. The ink ribbon is then wound back within the cassette 14 and the image receiving tape extends out of the printer. Reference numeral 16 denotes the printing zone where the image receiving tape and ink ribbon extend in overlap, and reference numeral 18 denotes the zone where the tape exits from the printer. Between zones 16 and 18 is an area in which cutting takes place as described below.

The cutting mechanism has two main parts. The first part is a cutter body 20 on which is mounted a full-cut blade 22. The blade 22 is configured to cut through the full thickness of the tape T as it moves towards a slot 24 in the cassette 14, at a first cutting location C1. The cutter body 20 moves on supports 56,58, and includes at its surface, a tape clamp 28 for holding the tape T against a supporting surface of the cassette 14 during cutting. Reference numeral 26 denotes a tape clamping spring of which there are two, one associated with each support 56,58. Operation of this part of the cutting mechanism is disclosed in our European Patent Application Publication No. 0634275, the content of which is expressly incorporated herein by reference thereto.

The second part of the cutting mechanism makes a tab cut through the tape at a second cutting location C2, spaced from the fixed cutting location C1. The tape T is preferably a multi-layer tape including an upper layer, an adhesive layer and a backing layer which can be removed from the adhesive layer so that the adhesive layer may be secured to an object using the adhesive layer. An image or message is printed on the upper layer of the tape. In FIG. 1, the upper layer of the tape is to the right of the drawing, adjacent the printhead 10.

The second part of the cutting mechanism includes a blade holder 30 which holds a tab cut blade 32. A tab cut blade holder 30 is mounted in a tab cut sprung body 34 which itself is sprung against a tab cut support part 36 of the printer. This part of the cutting mechanism also includes a rolling anvil 38. The rolling anvil 38 is rolled down against the tab cut blade 32 causing a cut to be made progressively across the width of the tape T. The depth of cut is controlled so that the cut is made only through the upper layer of the tape, leaving the backing layer intact.

The rolling anvil 38 has an arcuate anvil surface 3 and an actuating part 38*a*. FIG. 1 and 2 show the rolling anvil 38 in the start position. Two guides control the locus of the anvil 38. A first guide 40 is located towards the casing 2 of the printer, and a second guide 42 is located inwardly towards the cassette receiving bay. The guides 40,42 include guide tracks, and the anvil has two protrusions, such as balls or pins disposed near the ends of its arcuate anvil surface 3. The protrusions ride and are guided within the tracks. The pins cannot be seen in FIG. 2 because they are on the side of the rolling anvil away from the viewer. The pins located on the side of the anvil facing the viewer have been omitted from FIG. 2 for the sake of clarity. It will be appreciated that it is not necessary in all circumstances to positively guide the anvil from both sides. Guidance by a single guide on one side is sufficient in many applications.

The rolling anvil 38 also carries a cutter body actuation pin 48. This pin is disposed on the side of the anvil 38 that faces away from the viewer in FIG. 2. The cutter body 20 defines a track 50 in which pin 48 travels. The track 50 extends at an angle to the tape T.

Operation of this earlier cutting mechanism will now be described. FIG. 2 illustrates a start position. In this position, the return spring 8, which extends between upstanding part 6, around pulley 57, and terminates at the cutter body actuation pin 48, is in a relaxed state. The guide pins are located in an upper portion of the guide track. The cutter body 20 is in a position holding the blade 22 spaced from the tape T. To make a cut, the actuation part 38*a* of the rolling anvil 38 is moved in the direction of arrow A. When the anvil 38 is moved, the arcuate anvil surface 3 rolls along the surface of the tab cut blade holder and progressively tab cuts the tape at the second cutting location C2. The guide pins and guide track are arranged to ensure that anvil 38 repeatably rolls over the blade holder 38.

As the rolling anvil 38 moves, the cutter body actuation pin 48 is caused to move along the track 50 in the cutter body 20. This forces cutter body 20 towards the tape T.

Downward movement of the cutter body actuation pin 48 also extends and tenses return spring 8. As the cutter body 20 moves right in FIG. 2, the full cut blade 22, supported by the cutter body 20, makes a full cut through the tape T at the cutting location Cl.

Figure 3:
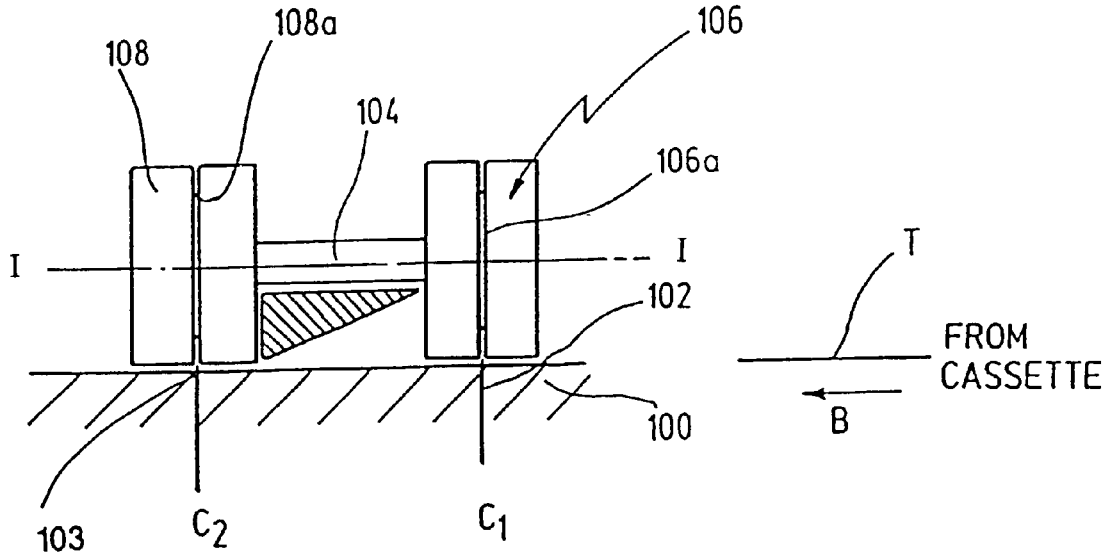
FIG. 3 is a sketch of components of a cutting mechanism according to the present invention.

FIGS. 3–5 show an embodiment of a cutting mechanism according to the present invention which does not require a cassette to have a slot in a support wall. In this embodiment, the location of the cutting mechanism independent of the placement of the cassette. Moreover, the cassette need not contain both image receiving tape T and thermal transfer tape. The thermal transfer tape may be contained in a separate cassette or dispensed with altogether.

Figure 4B:
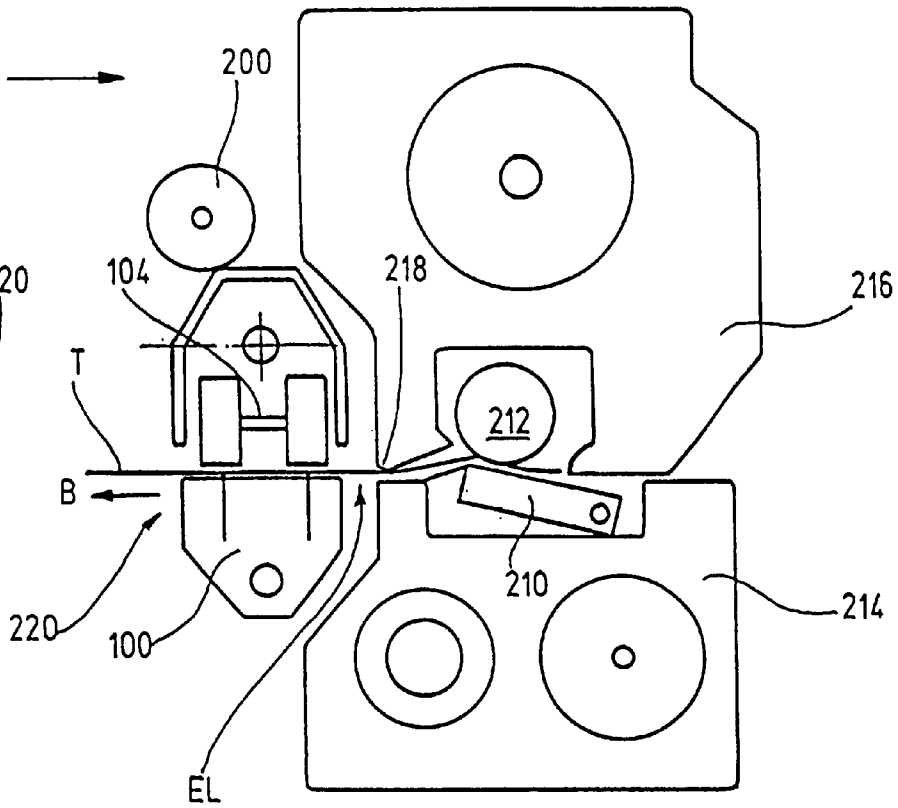
FIGS. 4A and 4B are a side view and plan view of a cassette layout in an embodiment of the invention.

Referring to FIG. 4B, a baseplate of the printing mechanism has been omitted for the sake of clarity, although a cassettes is preferably received in a cassette receiving bay. The printing device has a printing mechanism comprising a printhead 210 and a platen 212, similar to those described above. An ink ribbon cassette 214 houses a supply of ink ribbon or thermal transfer ribbon, and a substrate cassette 216 houses a supply of image receiving tape T. The image receiving tape T and the ink ribbon are passed in overlap through a print zone, between the printhead 210 and the platen 212, for printing. The ink ribbon is then fed back into the ink ribbon cassette 214, while the image receiving tape T with a printed image thereon is fed from the print zone towards the left in FIG. 4B. Rotation of the platen 212 moves the tapes.

Figure 4A:
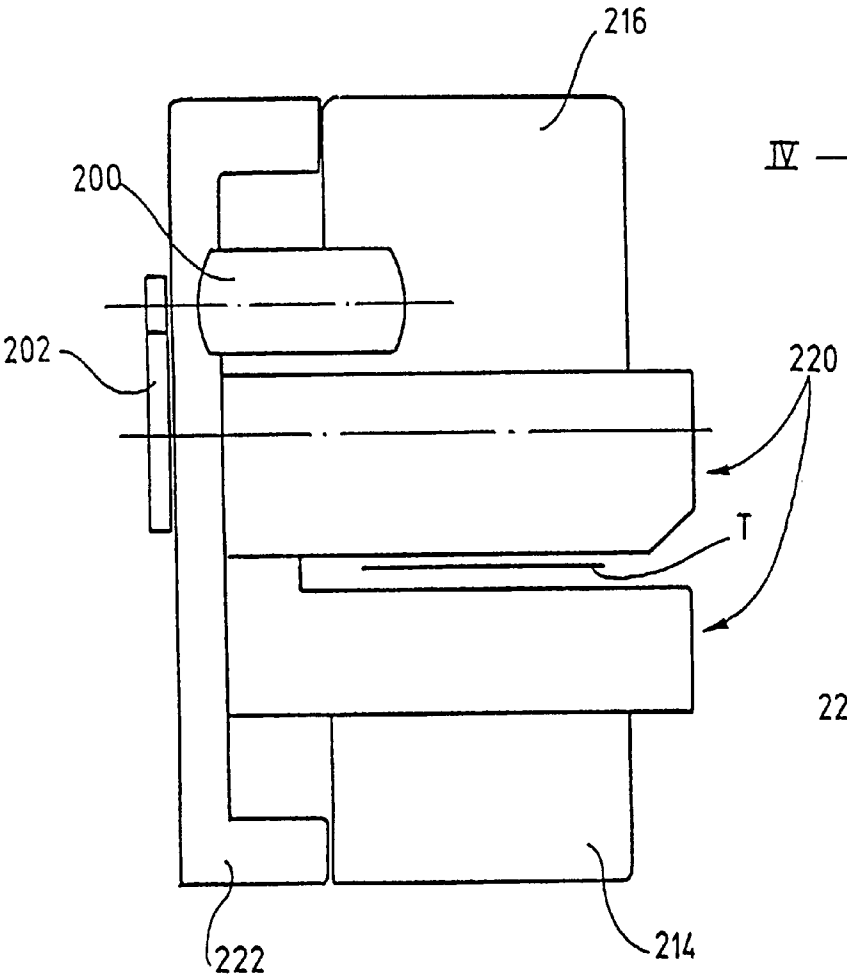

The substrate cassette 216 has a guide part 218 at an exit location EL that guides the tape T. Downstream of the exit location EL is a cutting mechanism 220. FIG. 4A is a view taken from the side of FIG. 4B in the direction of arrow IV. The baseplate 222 of the printing mechanism is seen supporting the ink ribbon cassette 214 and the substrate cassette 216. Tape T is shown exiting the printer in the direction of arrow B in FIG. 4A, and towards the viewer in FIG. 4A.

Referring to FIG. 3, the cutting mechanism 220 has a blade holder 100 which is located at a first cutting location C1 and has a full cut blade 102 for cutting through all layers of multi-layer tape T; and a tab cut blade 103, located at cutting location C2, for cutting through only one or more layers of a multi-layer tape, without cutting the backing layer. The cutting mechanism also includes an anvil holder 104 which carries two rolling anvils 106 and 108, as shown in FIG. 3, that are respectively opposed to each blade 102 and 103.

The first rolling anvil 106 cooperates with the full cut blade 102 as a first cutter, and the second of these 108 cooperates with the tab cut blade 103 as a second cutter. The anvil holder 104 is preferably a central shaft that is rotatable about its axis A—A. Each of the rolling anvils has a narrow circumferential slot 106*a* and 108*a* respectively. Each slot 106*a* and 108*a* is aligned with its opposing blade 102 and 103 to remove direct contact between the blades 102 and 103 and the anvils 106 and 108. The cutting locations C1 and C2 are spaced apart similarly as in FIG. 1 to provide a full cut at cutting location C1 and a tab cut at cutting location C2.

Figure 5A:
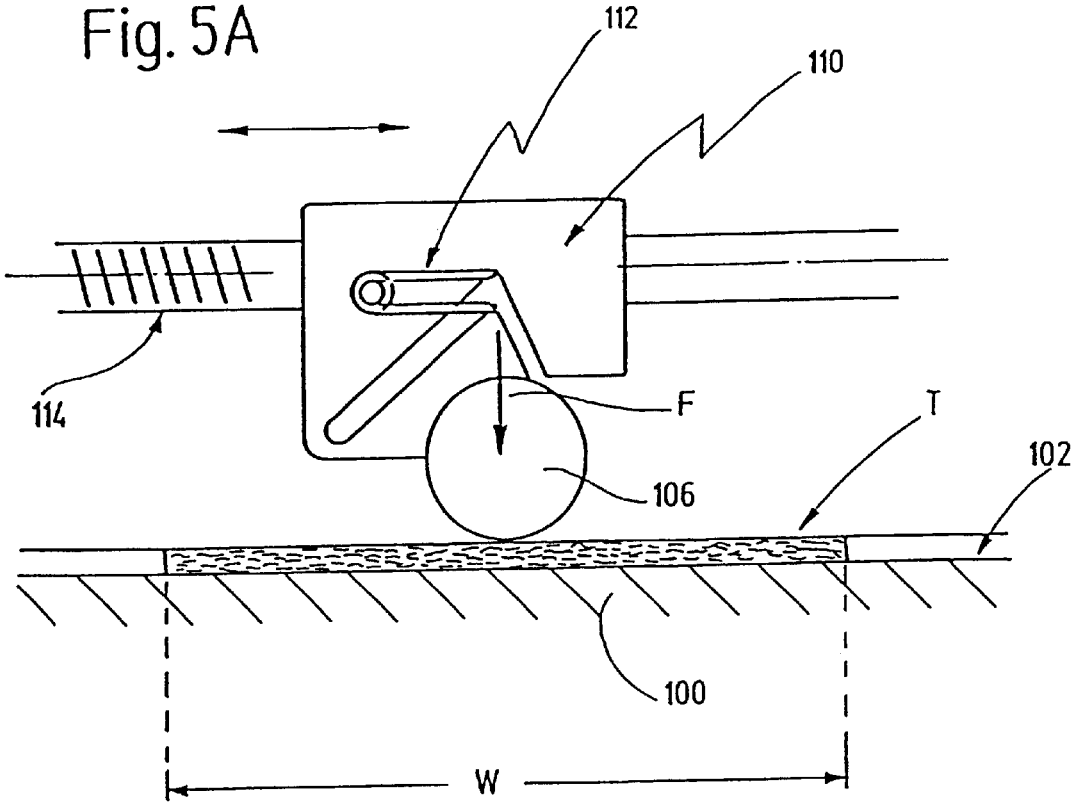
FIG. 5A is a view of the cutting mechanism of FIG. 3.
Figure 5B:
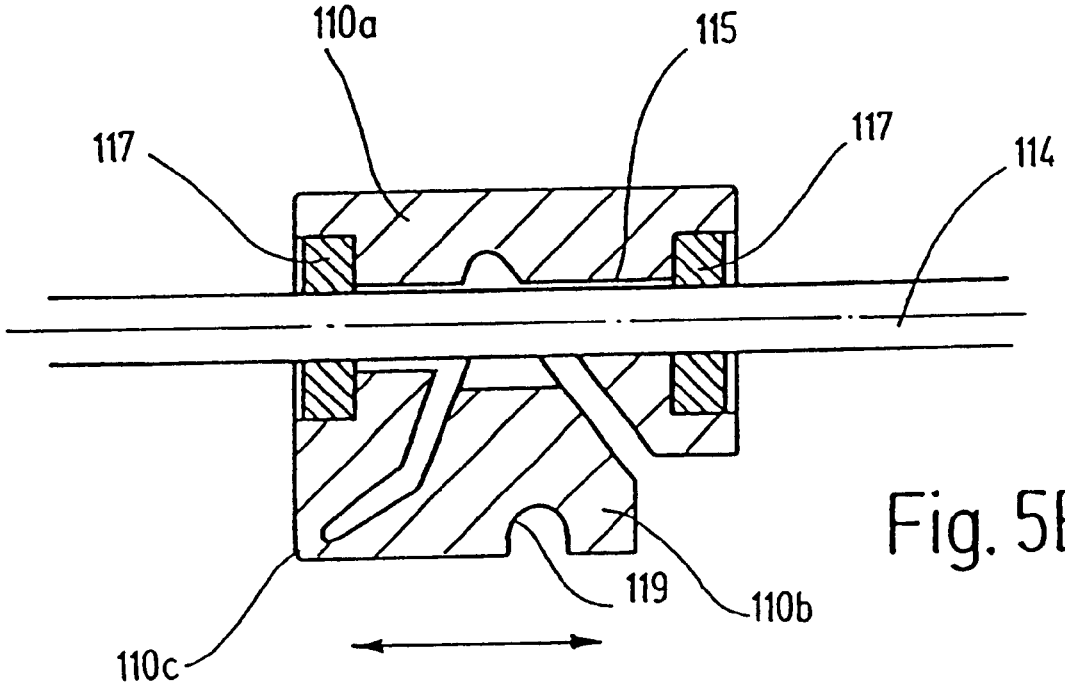
FIG. 5B is a section through a carriage shown in FIG. 5A.
Figure 5C:
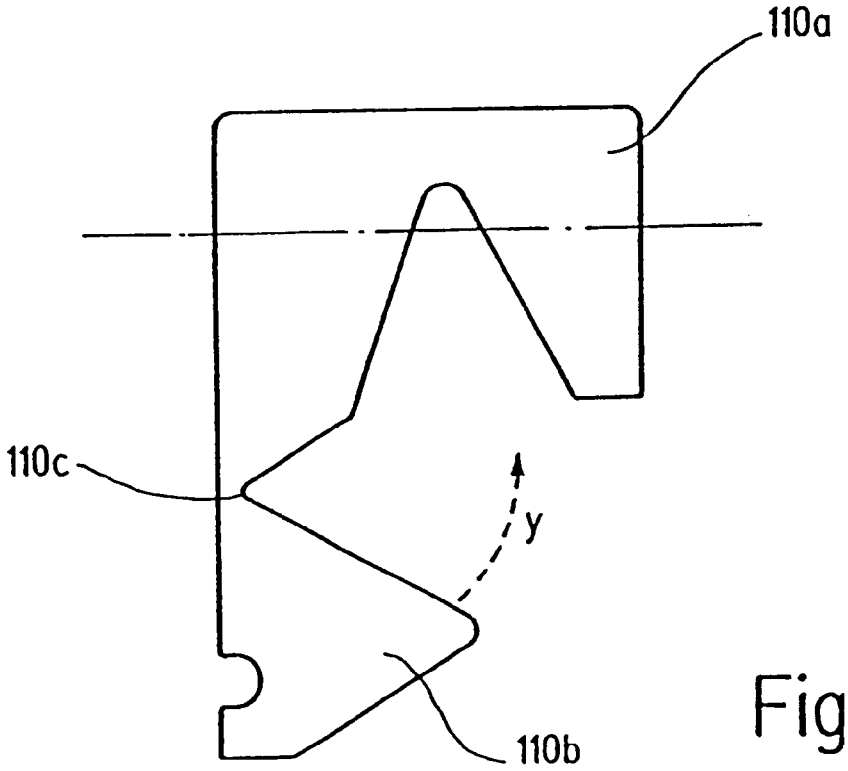
FIG. 5C illustrates the carriage of FIGS. 5A and 5B in its molded form.

FIGS. 5A–C are views taken from the end of the cutting mechanism 220, facing the same direction as FIG. 4A. In FIG. 5A, blade holder 100 is seen sectioned with the full cut blade 102 showing. The width of the tape is denoted W. The anvil holder 104 is mounted on a carriage 110 and is held under constant bias towards blade 102, against the blade holder 100, by spring 112. This downwards force produced by spring 112 is denoted by arrow F. The carriage is movable back and forth widthwise of the tape T under the action of a motor driven lead screw 114. As the carriage is driven by the lead screw 114, the rolling anvils 106 and 108 rotate causing, biasing tape T against blades 102 and 103.

FIG. 5B is a section through the carriage 110, showing its operation in more detail. The lead screw 114 extends through an aperture or bore 115 in the carriage 110 and is received by threaded nuts 117 at each end of the bore. Rotation of the lead screw 114 moves the carriage 110 widthwise over the tape.

The carriage 110 consists of a main body portion 110*a* and a hinged portion 110*b*. The hinged portion 110*b* has a recess 119 for receiving the holder 104 of the rolling anvils 106 and 108. The hinged portion 110*b* is hinged relative to the body portion 110*a* at hinge 110*c*. The spring 112 biases the body portion 110*a* away from the hinged portion 110*b*, applying the downwards force F explained above with reference to FIG. 5A.

For ease of manufacture, the carriage 110 is manufactured as an integral unit in which the hinged portion 110*b* is open relative to the body portion 110*a*. This is shown in more detail in FIG. 5C. By manufacturing the carriage in this manner, the spring 112 can be mounted onto the carriage 110, and the hinged portion 110*b* may be folded back in the direction of arrow Y, simplifying assembly.

Figure 6:
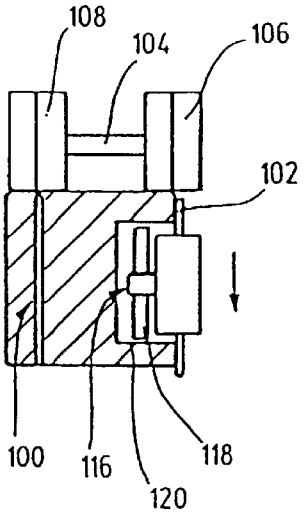
FIG. 6 illustrates a preferred embodiment of the invention in which a full cut blade is selectively disengageable.

Referring to FIG. 6, in a preferred embodiment of the invention, the full cut blade 102 can be selectively engaged or disengaged to allow the cutting mechanism either to perform a full cut with a tab cut, or a tab cut only. FIG. 6 is a view similar to FIG. 3 and shows the rolling anvils 106 and 108 on the anvil holder 104.

Figure 7A:
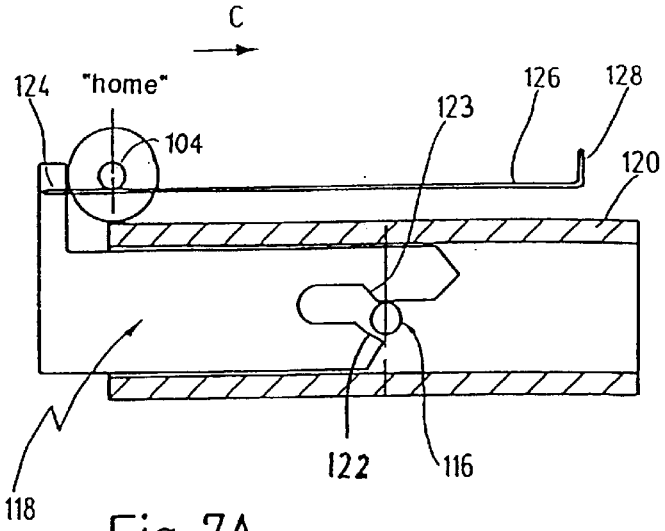
FIGS. 7A–C are end views of the cutting mechanism of FIG. 6.

The full cut blade 102 is mounted on cam-engagement portion such as a pin 116 which is actuated by a key 118. The key 118 is has an elongate part which runs in a guide groove 120 formed in the blade holder 100. In FIG. 7A, the key 118 is shown in its retracted position. The key 118 has first and second cam surfaces 122 and 123 that are engageable with pin 116. The key 118 also has an actuating part 124 that extends upwardly from the elongate part of the key 118. The actuating part 124 carries an actuator 126 which extends lengthwise of the blade holder 100, in the direction of movement of the carriage 110.

FIG. 7A shows the anvil holder 104 in its "home" position, at the extreme left hand side of its travel. In this position, the carriage 110 holds the actuating part 124 of the key 118 so that the second cam surface 123 holds pin 116 downwards, disengaging the full cut blade 102. As the anvil holder 104 rolls from the home position to the right hand side of FIG. 7A in the direction of arrow C, only a tab cut is produced on the tape T.

Figure 7B:
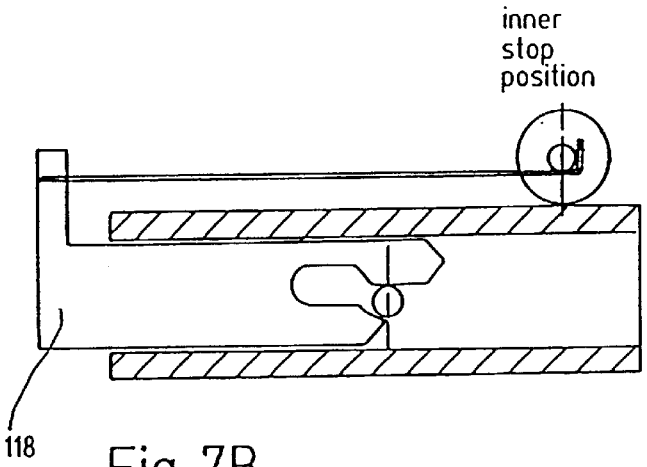
Figure 7C:
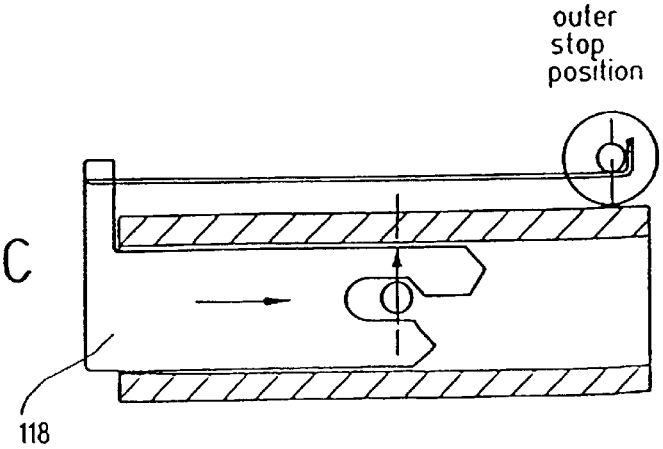

The anvil holder 104 has two stop positions, an inner stop position shown in FIG. 7B and an outer stop position shown in FIG. 7C. At the inner stop position, the anvil holder 104 abuts a first end 128 of the actuator 126, but engages it no further and causes no movement of the key 118. Therefore, the full cut blade 102 remains in its disengaged position. Hence, when the anvil holder 114 returns from the inner stop position to its home position, no full cut of the label is made.

However, if the anvil holder 104 rolls to the outer stop position shown in FIG. 7C, it will readily be understood that it has now engaged the first end 128 of the actuating component 126, pulling key 118 to the right in the drawing. The second cam surface 123 of the key 118 releases the pin 116. The full cut blade 102 is returned to its cutting position, preferably as the first cam surface 122 engages pin 116. On the return stroke of the anvil holder 104, as it moves towards its home position, a full cut is produced through the tape.

Once a full cut is made, the anvil holder 104 shifts the actuating component 124 of the key 118, which coincides with a second end of the actuator 126, back towards the left as the holder 104 reaches its home position. The second cam surface of key 118 thus moves pin 116 down, also moving the full cut blade 102 to its disengaged position. Consequently, the cutting mechanism will not make a full cut through the tape T in the next outbound stroke of the anvil holder 104. In this embodiment, full cuts are only performed during the return stroke of the anvil holder 104.

Figure 8:
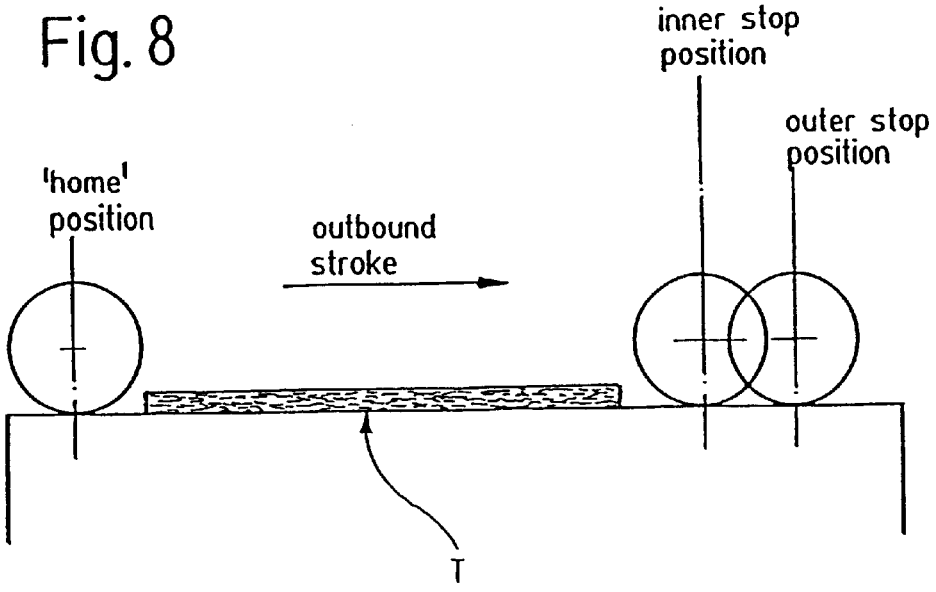
FIG. 8 is a sketch showing different stop positions of an anvil holder according to the invention.

FIG. 8 shows the home position, inner stop position, and outer stop position with reference to the width of the tape T. This arrangement thus allows a user to select whether or not both a full cut and a tab cut are to be made, or a tab cut only. This can be done automatically using the arrangement shown in FIG. 9.

Figure 9:
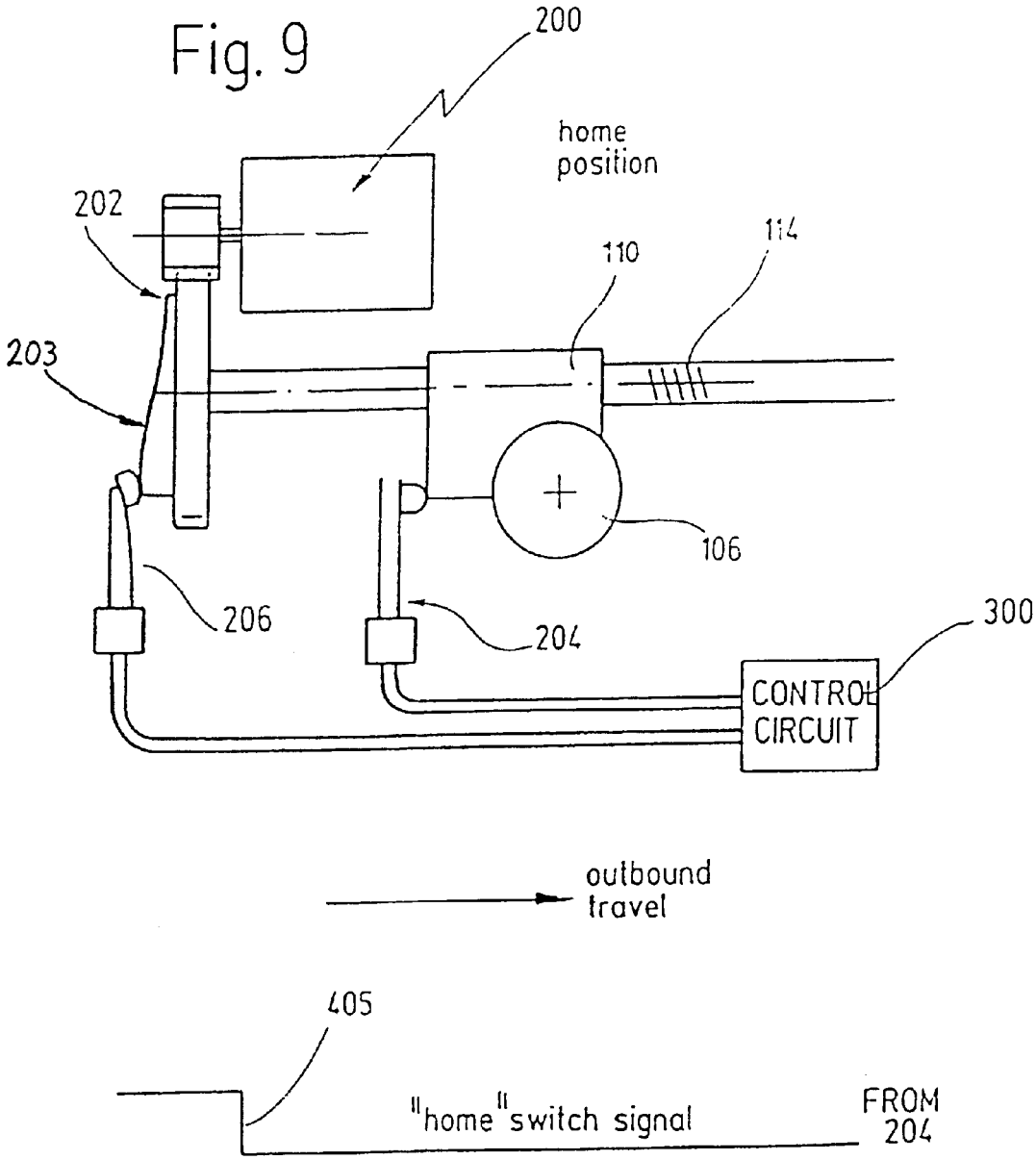
FIG. 9 is a diagram showing drive and sensing components of the cutting mechanism of FIG. 6.
Figure 10:
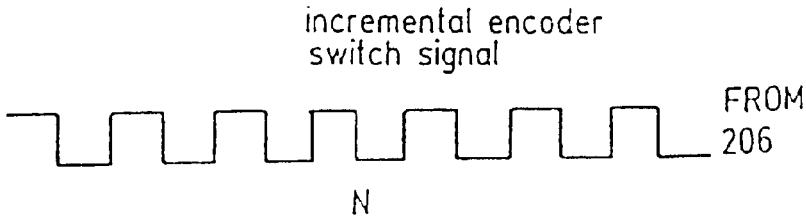
FIG. 10 is a diagram showing signals from the sensing components of FIG. 9.

FIG. 9 does not show the blade holder but shows the carriage 110 with the rolling anvil 106. As described above with reference to FIG. 5A, the carriage 110 is driven on a lead screw 114. Reference numeral 200 denotes a d.c. motor which is used to drive the lead screw 114 through a gear reduction pair 202. A first leaf switch 204 is provided to detect the home position of the anvil holder 104. Detection of the inner stop position and outer stop position is accomplished through a second leaf switch 206 which detects revolutions of a second gear 203 of the gear reduction pair 202. This is accomplished in this embodiment by providing a face cam 203 on the second gear. Thus, for every revolution of the lead screw 114, a pulse is generated at the second leaf switch 206, thus forming a simple incremental encoder. FIG. 10 illustrates the respective signals from the first leaf switch 204 and the second leaf switch 206.

Figure 11:
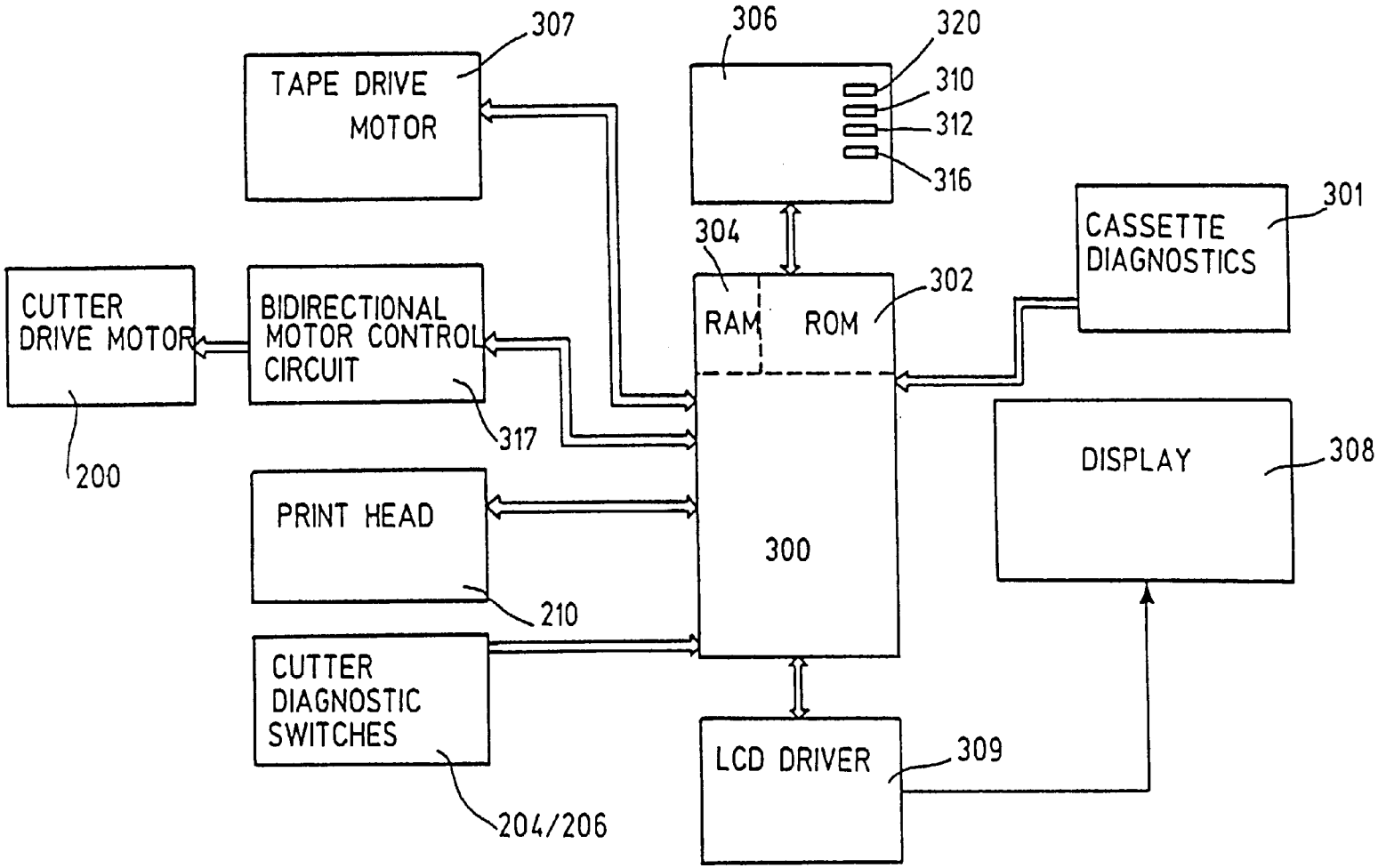
FIG. 11 is a block diagram of control circuitry of the preferred embodiment.

FIG. 11 is a block diagram of circuitry of a printing device for implementing the above-referenced feature. FIG. 11 illustrates a central controller 300 for the printing device, which includes a microprocessor, ROM 302 and RAM 304. The controller 300 is connected to an LCD driver 309 for driving a display 308 of the printing device. The display 308 and its driver 309 can be located remotely from the printing device itself. The controller 300 also communicates with a keyboard 306 or other input device for receiving information concerning data to be printed and cutting operations and the like. For this, a plurality of keys are provided which are illustrated by way of example as keys 320,310,312, and 316. The keyboard 306 can be located remotely from the printing device itself. The controller 300 is also connected to the printhead 210 and to a tape drive motor 307 for driving the platen 212 to feed tape through the printing device. The printhead 210 and tape drive motor 307 effect printing and feeding operations under the control of the controller 300 in known manner. The controller 300 is also connected to a bidirectional motor control circuit 317 which controls the operations of the cutter drive motor 200.

The controller 300 receives information from the cutter diagnostic switches 204,206 illustrated in FIG. 9. The controller 300 is also connected to cassette diagnostic switches 301 which are located in the cassette receiving bay of the printing device and which identify parameters concerning the cassette and transmit these to the controller 300. These parameters preferably include the nature of the tape and its width.

Figure 12:
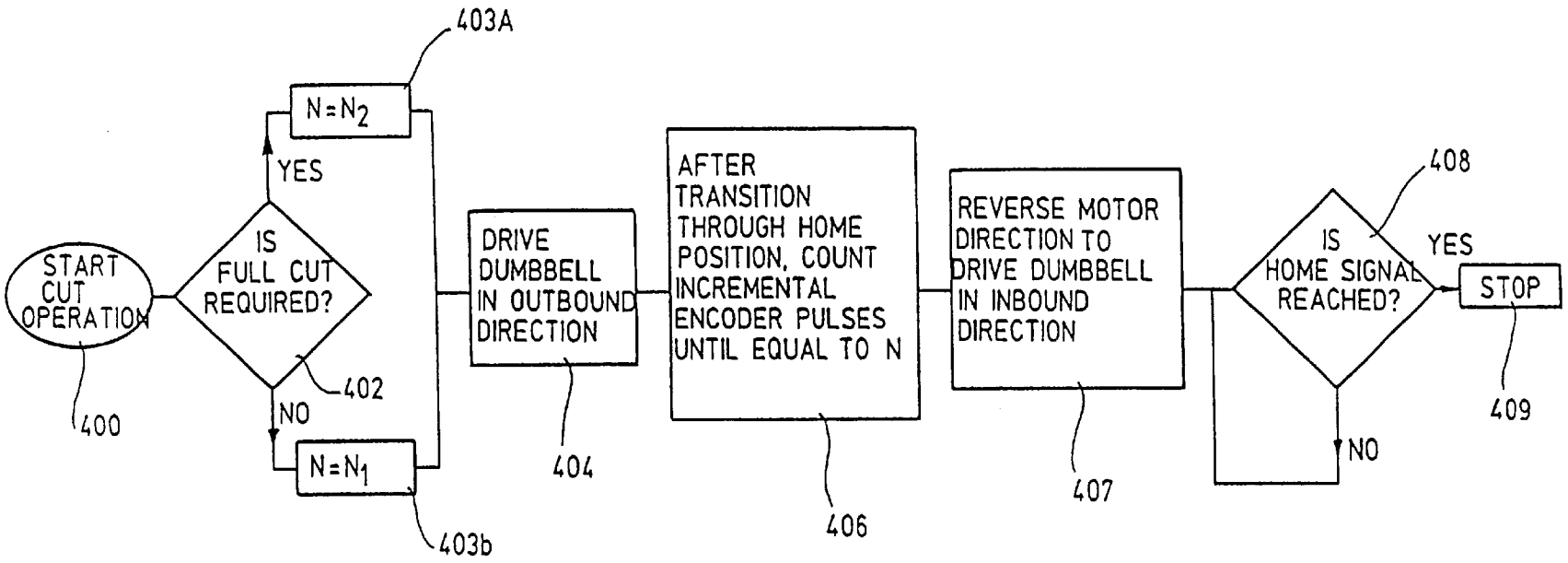
FIG. 12 is a flow chart of a selective cutting operation.

Referring to FIG. 12, the control circuit 300 receives respective signals from the cutter diagnostic switches 204, 206 and can thus determine the position of the carriage 110. It can consequently arrange to reverse the direction of travel of the anvil holder 104 at a selected one of the inner stop position and outer stop position.

At step 400, a cut operation commences. This can be done by the user's depressing a cut button on the keyboard 306, or could be automatically initiated by the machine in response to having printed a certain length of label. At step 402, the controller 300 inquires whether a full cut is required. The user answers this inquiry at the time of formatting the label or at the time of instigating a cutting operation. According to the answer, a number N is set defining the number of encoder pulses to expect from the diagnostic leaf switch 206. If a full cut is required, the number N is set to N2, whereas if a tab cut only is to be implemented, the number N is set to N1. It will be apparent that N1 is less than N2 because the outbound travel of the carriage 100 for the tab cut only case is less than where a full cut is to be implemented on the return stroke.

Step 404 causes the carriage 110 to be driven in the outbound direction by starting the motor 200. The diagnostic leaf switch 204 determines when the carriage has passed through the home position, as denoted by the transition 405 in FIG. 10. This transition is detected at step 406 and the controller then proceeds to count the incremental encoder pulses derived from the diagnostic leaf switch 206. When N equals the preset number (N1 or N2 as determined by steps 403*a*,403*b*), the motor direction is reversed at step 407 to drive the carriage 110 in the inbound direction. When the home signal is reached (step 408), the sequence is terminated (step 409). When the second diagnostic switch 204 is closed, the controller 300 shuts off the DC motor 200.

Thus, a user can request labels with or without a full cut via a user interface of the printing device. Furthermore, a string of score cut labels can be produced and, after the last, the control circuit can cause the cutting mechanism to produce a full cut with the final tab cut, to separate the string from the printing device. More details concerning the manner in which score cut labels, separated by tab cuts, can be produce are disclosed in our U.S. Pat. No. 5,458,423, the content of which is expressly incorporated herein by reference thereto.

Figure 13:
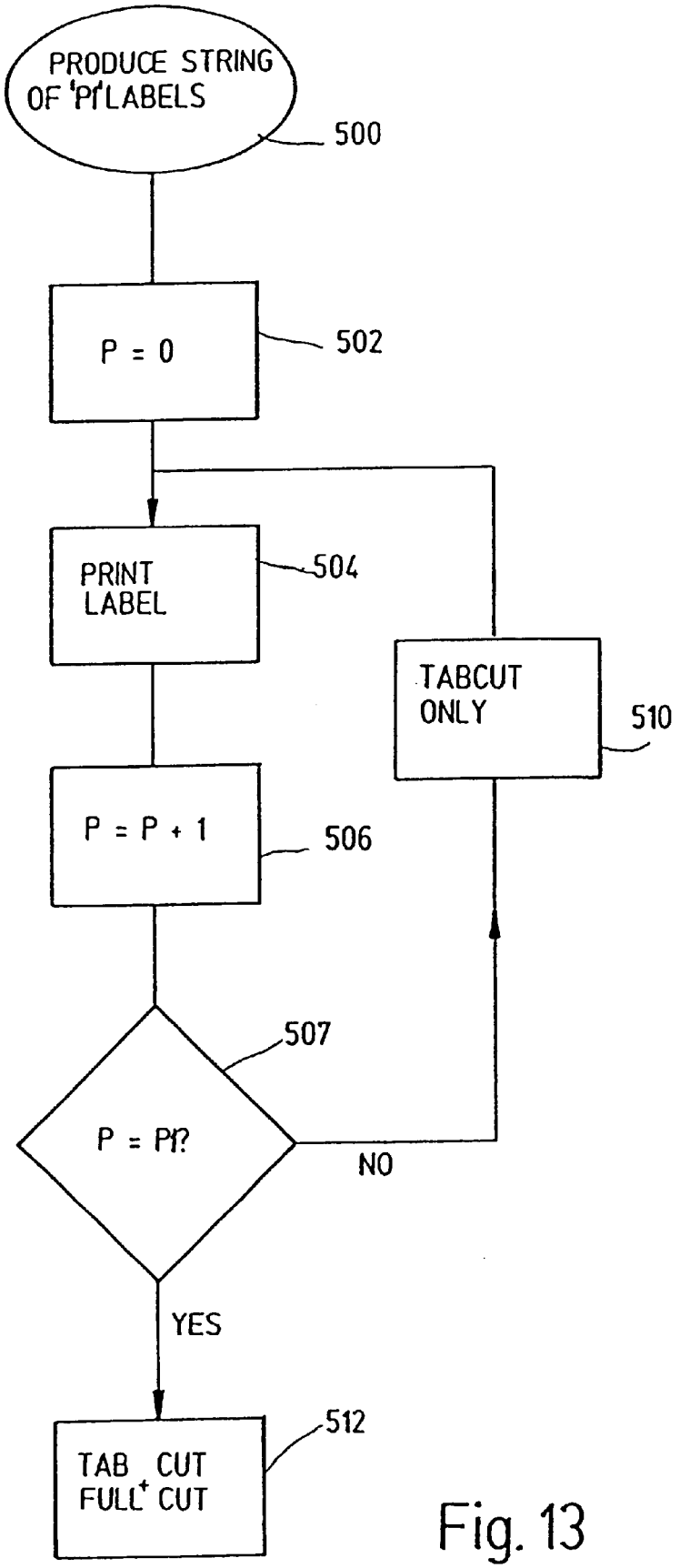
FIG. 13 is a flow chart showing operation in a preferred strip label mode.

FIG. 13 is a flow chart illustrating how a string of score cut labels can be produced, with the string being terminated at a full cut. The flow chart in FIG. 13 starts from the point when a user has requested a string of P1 labels, each label being separated from its neighbor only by a tab cut but remaining attached to a common strip of backing tape. This is denoted as step 500 in the flow chart.

Prior to printing of the first label, at step 502 the processor sets P=0. The processor then prints the first label of the string at step 504. At step 506, P is incremented, and at step 507 it is compared with P1. Naturally, for the first label P will not equal P1, and therefore the full cut blade 102 is disengaged as explained above. Only a tab cut is then produced, as illustrated at step 510.

When P=P1, the full cut blade is no longer disengaged so that at the next cut the string of labels is cut off while simultaneously performing a tab cut on the final label. This is shown at step 512.

Figure 14:
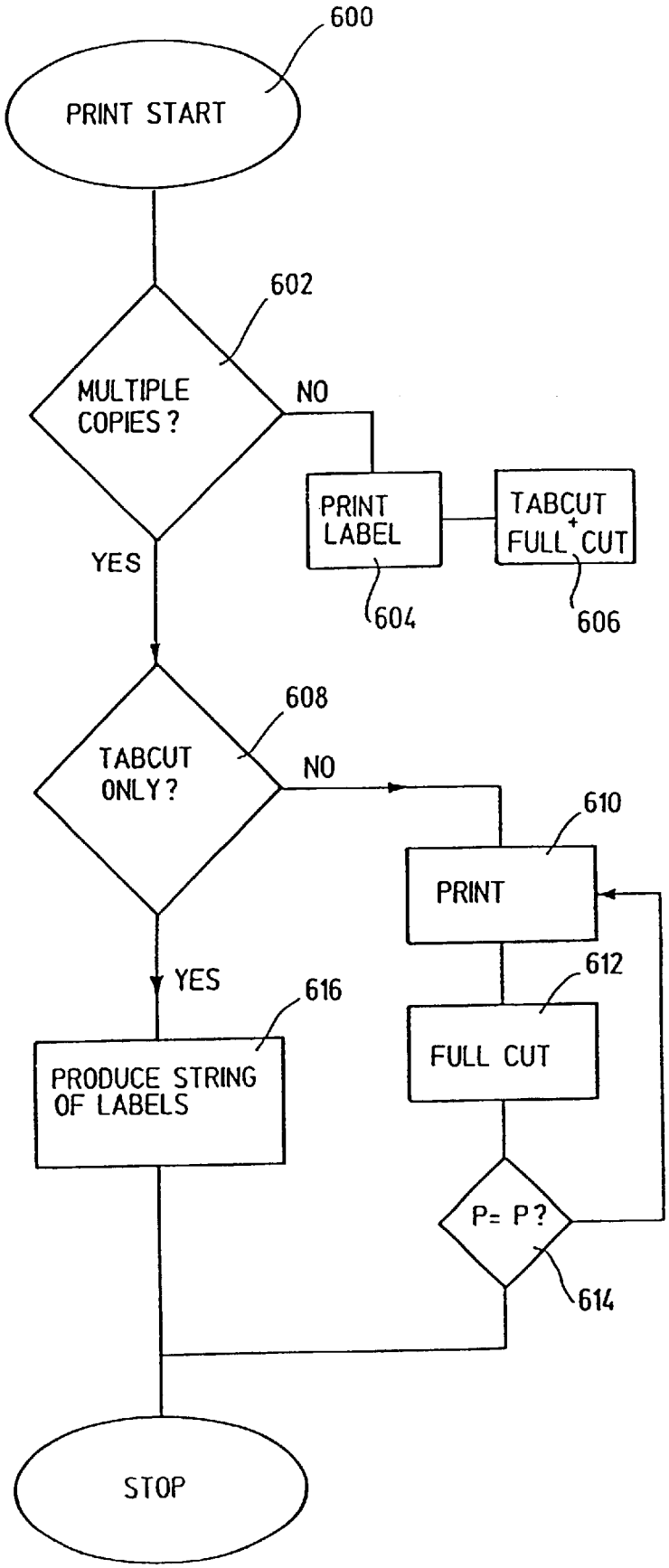
FIG. 14 is a flow chart illustrating a process of selection of cutting options by a user.
Figure 15:
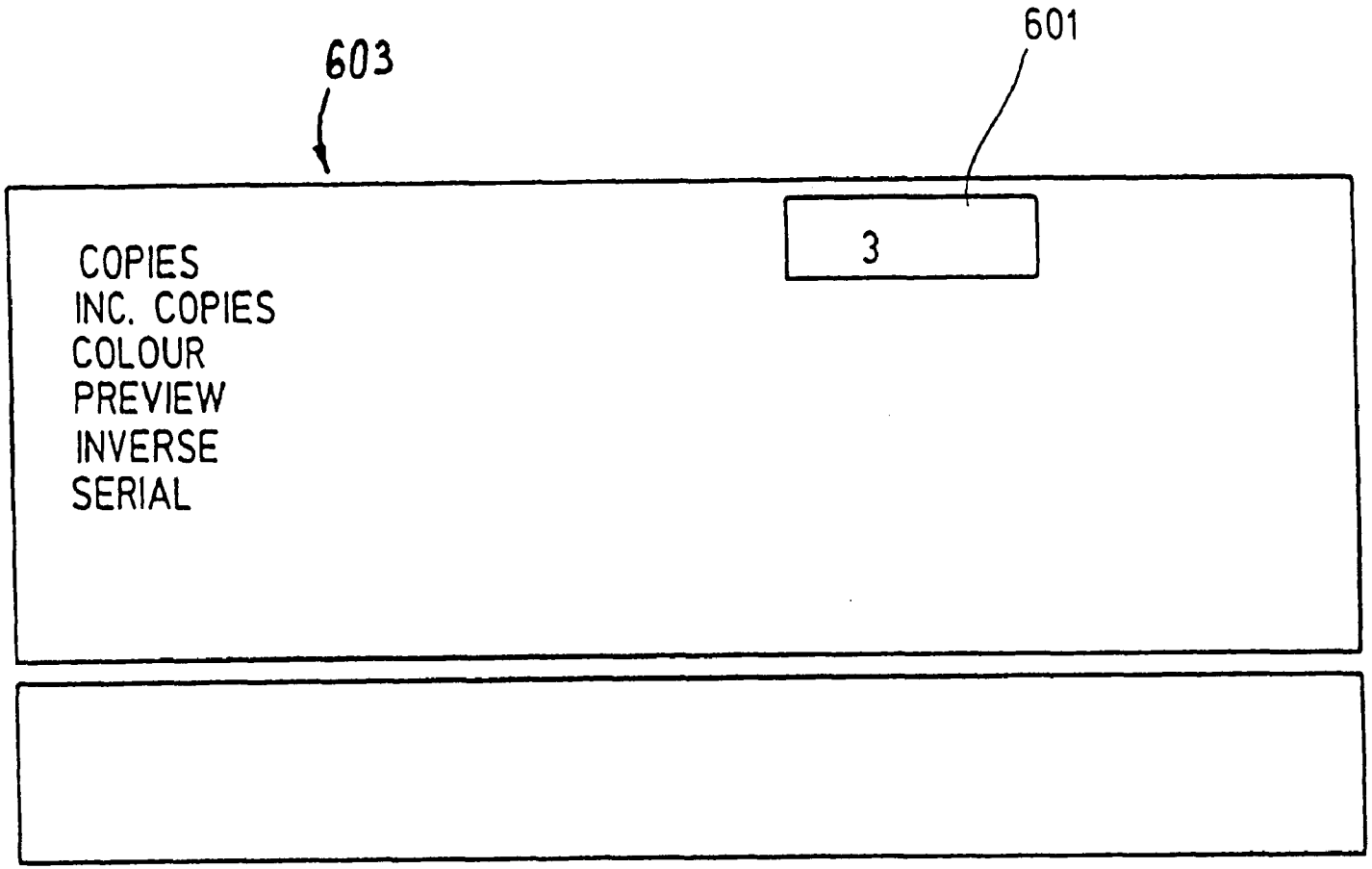
FIG. 15 shows a printer display, according to the invention, displaying options in a special mode.

FIG. 14 is a flow chart illustrating how a user selects an appropriate option at the user interface. As described in more detail in our copending British application GB 9614144.5, the printing device has a user interface with a display and various input keys. These input keys include a PRINT key, a set of FUNCTION keys, a SELECT key and a set of DATA INPUT keys. The Function keys include a SET UP key and a SPECIAL key which allow the various cutting options discussed herein to be selected by a user. A print operation is selected by a user by depression of the print key, as indicated at step 600. By depression of the special key, a menu of label select options is displayed on the screen 603 as illustrated in FIG. 15. By using cursor keys, a user can mark one of the following displayed options: copies; inc. copies; color; preview; inverse; or serial.

A user may also enter a number in the displayed block 601 adjacent the selected option. The processor then determines at step 602 whether or not multiple copies have been selected. If printing only a single label was selected, the processor proceeds to print the label at step 604 and perform a cutting operation implementing a tab cut and a full cut at step 606.

Figure 16:
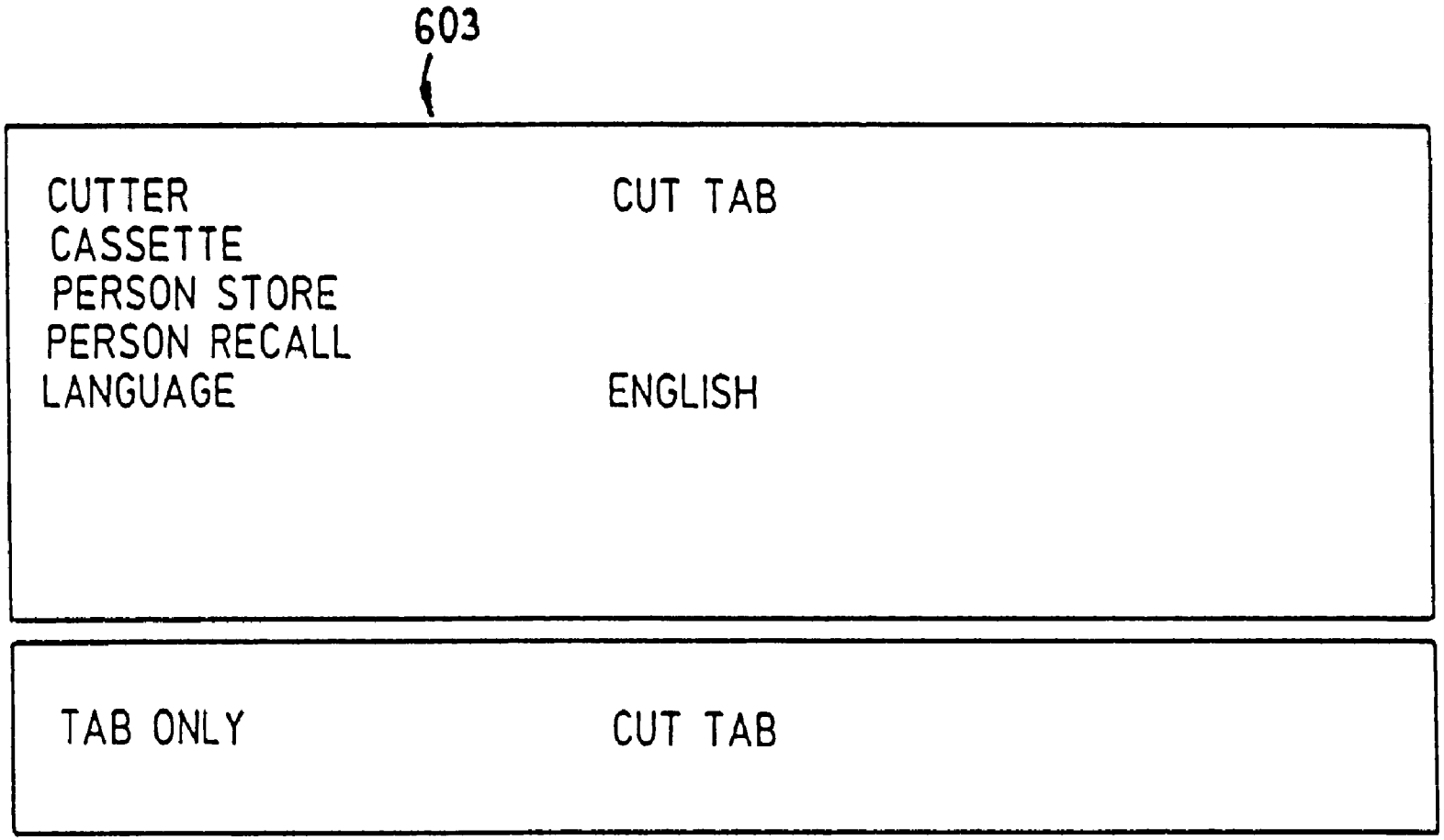
FIG. 16 is a display showing options in a set up mode.

By depression of these set up function keys, a user can cause to be displayed the menu of options illustrated in FIG. 16, giving the cutting options: tab only; or cut tab. If the user has selected a tab only option, this is determined by the processor at step 608. If a full cut has been selected, a sequence of copies of a label is printed and individually cut off with a full cut as shown in a sequence of steps 610, 612 and 614.

If a tab only selection has been made, the user goes into the sequence illustrated in FIG. 13 denoted in block 616 in FIG. 14.

It will be appreciated that the processor will need to make some adjustment for the lead length of a label when it is operating in a score cut mode as opposed to when it is implementing a full cut. This can be adjusted in the manner described and explained in U.S. Pat. No. 4,458,423.

As outlined above, the user can select multiple copies of the same label. The printing device can count the number of copies and display that to a user if desired. The display can show how many copies have been printed or how many are remaining to be printed. Moreover, the printing device can be set up to provide incremental copies. That is, the printing device can print a sequence of labels in which each label has a number, subsequent labels having that number plus one. For instance, the first label could be printed with a "1", the second with a "2", and so forth. The user can also select a number of labels which are being printed with the same incremental number. Thus, for example the user could select three repetitions of each incremental number, resulting in the first three labels having a "1", the next three having a "2", and so on.

As a further option, the leader of a label may be reduced by commencing a print operation so that part of the label is printed, then stopping the print operation to perform a tab cut after a predetermined length has been fed, then proceeding to print the complete label. This allows shorter labels to be produced and thus reduces the amount of wasted tape.

What is claimed is:

1. A tape printing device comprising:

a printing mechanism for performing printing operations on a multi-layer tape;

a cutting mechanism for performing cutting operations on said multi-layer tape, the cutting mechanism comprising first and second cutting blades, the first cutting blade being arranged to cut through all layers of the multi-layer tape and the second cutting blade being arranged to cut through one or more layers of the multi-layer tape, but leaving at least one layer intact and spaced at a location lengthwise of the tape with respect to the first cutting blade;

a keyboard comprising data input components for allowing a user to define an image to be printed and a cutter control component for allowing a user to select a cutting mode; and a cutter controller connected to receive a control signal from the keyboard and responsive to said control signal to selectively deactivate the first cutting blade while leaving the second cutting blade activated, in at least one of said selected cutting modes.

2. A printing device according to claim 1 wherein cutting mechanism comprises a first part fixed to supports on said printing device, and a second part being movably supported with respect to said first part, wherein the first part and the second part are mounted for relative motion so that as said motion occurs the cutting operations are carried out.

3. A printing device according to claim 2 wherein a motor is provided for driving said motion of said second part.

4. A printing device according to claim 3 wherein selective engagement and disengagement of said first cutting blade is performed by action of said movement of said second part of said cutting mechanism, and selective engagement and disengagement of said first cutting blade is responsive to the distance over which said second part has moved.

5. A printing device according to claim 4 wherein a diagnostic switch for detecting the distance said second part has moved is connected to a controller for controlling said motor.

6. A printing device according to claim 5 wherein the diagnostic switch sends pulses counted by the controller when said second part is moving.

7. A printing device according to claim 4 wherein the cutting action of said first cutting blade is performed at the end of a return stroke of said second part.

8. A printing device according to claim 7 wherein the deactivation of said first cutting blade is performed at the end of an inbound stroke of said second part.

9. A printing device according to claim 7 wherein the second part causes a movement of an element supporting the first cutting blade at the end of said inbound stroke such that said first cutting blade is moved into its operative position.

10. A printing device according to claim 2 wherein the second part causes a movement of an element supporting the first cutting blade at the end of an inbound stroke such that said first cutting blade is moved into its operative position.

11. A printing device according to claim 4 wherein a sensor for detecting that said second part has reached its home position is connected to a controller for controlling said motor.

12. A tape printing device comprising:

a printing mechanism for performing printing operations on a multi-layer tape;

a cutting mechanism for performing cutting operations on said multi-layer tape, the cutting mechanism comprising first and second cutting blades, the first cutting blade being arranged to cut through all layers of the multi-layer tape and the second cutting blade being arranged to cut through one or more layers of the multi-layer tape, but leaving at least one layer intact and spaced at a location lengthwise of the tape with respect to the first cutting blade, wherein the cutting mechanism further comprises a first part fixed to a frame of said printing device, and a second part being movably supported with respect to said first part, wherein the first part and the second part are mounted for relative motion so that as said motion occurs the cutting operations are carried out, wherein said second part of said cutting mechanism comprises an anvil holder carrying first and second anvils arranged to cooperate respectively with said first and second cutting blades and to be mounted for rolling motion so that as said rolling motion widthwise of the tape occurs the cutting operations are carried out;

a user interface comprising data input components for allowing a user to define an image to be printed and a cutter control component for allowing a user to select a cutting mode; and a cutter controller connected to receive a control signal from the user interface and responsive to said signal to selectively deactivate the first cutting blade in one of said selected cutting modes.

13. A printing device according to claim 12 wherein the first and second cutting blades are mounted on a common blade holder.

14. A printing device according to claim 12 wherein each anvil is provided with a circumferential slot aligned with its respective blade.

15. A printing device according to claim 12 wherein the anvil holder is mounted for rotation with respect to a carriage, the carriage being mounted for linear movement in the direction widthwise of said tape.

16. A printing device according to claim 15 wherein the carriage is mounted on a lead screw, rotation of the lead screw causing said linear motion of the carriage.

17. A printing device according to claim 16 wherein the anvil holder is biased relative to said first and second cutting blades.

18. A tape printing device comprising:

a printing mechanism for performing printing operations on a multi-layer tape;

a cutting mechanism for performing cutting operations on said multi-layer tape, the cutting mechanism comprising first and second cutting blades, the first cutting blade being arranged to cut through all layers of the multi-layer tape and the second cutting blade being arranged to cut through one or more layers of the multi-layer tape, but leaving at least one layer intact and spaced at a location lengthwise of the tape with respect to the first cutting blade;

a keyboard comprising data input components for allowing a user to define an image to be printed and a cutter control component for allowing a user to select a cutting mode from a first cutting option in which both first and second cutting blades are active and a second cutting option in which the first cutting blade is inactive; and a cutter controller connected to receive a control signal from the keyboard and responsive to said control signal to selectively deactivate the first cutting blade while leaving the second cutting blade activated, when said second cutting option is selected.

19. A printing device according to claim 18 wherein in a third cutting option a strip of labels only separated by cuts performed by said second blade is produced, wherein the cutter controller controls said first cutting blade such that the last cut of said label strip is performed in said first cutting option.

* * * * *